US006065989A

United States Patent [19]

Walkup et al.

[11] Patent Number: 6,065,989

[45] Date of Patent: May 23, 2000

[54] BOARD-TO-BOARD CONNECTOR BLOCK WITH CLOSING MECHANISM

[75] Inventors: William B. Walkup, Hillsboro, Oreg.; Robert G. McHugh, Evergreen, Colo.; Spencer Lai, Shin-Juang, Taiwan

[73] Assignee: Hon Hai Precision Ind. Co., Ltd., Taipei Hsien, Taiwan

[21] Appl. No.: 09/222,567

[22] Filed: Dec. 28, 1998

[51] Int. Cl.[7] ..... H01R 13/625

[52] U.S. Cl. ..... 439/341; 439/372; 439/66

[58] Field of Search ..... 439/326, 325, 439/372, 157, 153, 152, 266, 310, 66, 74, 347, 159, 160, 299, 327, 329, 629, 341, 545, 338

[56] References Cited

U.S. PATENT DOCUMENTS 3,836,885 9/1974 Larsile ..... 439/341
4,678,252 7/1987 Moore ..... 439/62
5,104,330 4/1992 Yagi et al. ..... 439/157
5,395,258 3/1995 Okumura et al. ..... 439/157

*Primary Examiner*—Gary F. Paumen
*Assistant Examiner*—Ross Gushi

[57] ABSTRACT

A board-to-board connector block for horizontally and electrically engaging a secondary board with a source board includes an insulative housing defining a plurality of passageways therethrough for receiving a corresponding plurality of resilient contacts therein, positioning means for properly aligning the connector block onto the source board, a U-shaped lever pivotably engaged with the housing, stabilizing means for holding the lever in place when in a locked position, and fastening means for securing the lever onto the housing. A force from the lever acting on the resilient contacts of the connector block results in a reactive force from each contact acting on a corresponding contact pad of the source board thereby securely and electrically engaging the two boards together.

19 Claims, 5 Drawing Sheets

BOARD-TO-BOARD CONNECTOR BLOCK WITH CLOSING MECHANISM

BACKGROUND OF THE INVENTION

1. Field of the Invention

The present invention relates to an electrical connector, and more particularly to a board-to-board connector block with a closing mechanism for easily and effectively engaging two printed circuit boards.

2. The Prior Art

The expansion of a computer's memory and capability is often achieved through the addition of secondary printed circuit boards electrically connected to a source board of the computer. The secondary board can be connected to the source board by means of a vertical card connector which has one surface mounted to the source board and receives an edge of the secondary board in a slot defined in another surface thereof so that the secondary board is positioned perpendicular to the source board. Alternatively, a horizontal card connector assembly can be sandwiched between the two PC boards thereby promoting a more efficient use of space.

Horizontal card connector assemblies commonly consist of a plug connector mounted to a bottom surface of the secondary board and a receptacle connector mounted on a top surface of the source board using well-known surface mounting techniques. The plug and receptacle connectors are then mated together for transmitting signals between the two PC boards. Since the conventional horizontal card connector assembly requires soldering of each connector onto the corresponding PC board before the connectors are mated together in addition to fastening a set of screws, nuts, and washers in holes defined in both the assembly and the boards for firmly securing the connection therebetween, manufacture and assembly thereof becomes laborious as well as time and cost inefficient. Therefore, an improved board-to-board connector is required which can overcome the above-mentioned drawbacks.

SUMMARY OF THE INVENTION

Accordingly, one objective of the present invention is to provide a board-to-board connector block for horizontally and electrically engaging a secondary board with a source board which requires the soldering of only one board onto a surface of the connector block thereby simplifying manufacture and assemble thereof.

Another objective of the present invention is to provide a board-to-board connector block having a closing mechanism for properly and securely sandwiching the connector block between the two boards without the use of external tools.

To fulfill the above objectives, in accordance with one aspect of the present invention, a board-to-board connector block for horizontally and electrically engaging a secondary board with a source board includes an insulative housing defining a plurality of passageways therethrough. Each passageway receives a resilient contact therein for electrically connecting contact pads formed on the two boards. The connector block also includes positioning means for properly aligning the connector block onto the source board, a U-shaped lever forming a trunnion inwardly projecting from each arm thereof for pivotably engaging with holes defined in opposite lateral walls of the housing, stabilizing means for holding the lever in place when in a locked position, and fastening means for securing the lever onto the connector block. A force from the lever acting on the resilient contacts of the housing results in a reactive force from each contact acting on a corresponding contact pad of the source board thereby securely and electrically engaging the two boards together.

These and additional objectives, features, and advantages of the present invention will become apparent after reading the following detailed description of the preferred embodiments of the invention taken in conjunction with the appended drawing figures.

DETAILED DESCRIPTION OF THE PREFERRED EMBODIMENTS

Detailed reference will now be made to the preferred embodiments of the present invention.

Figure 1:
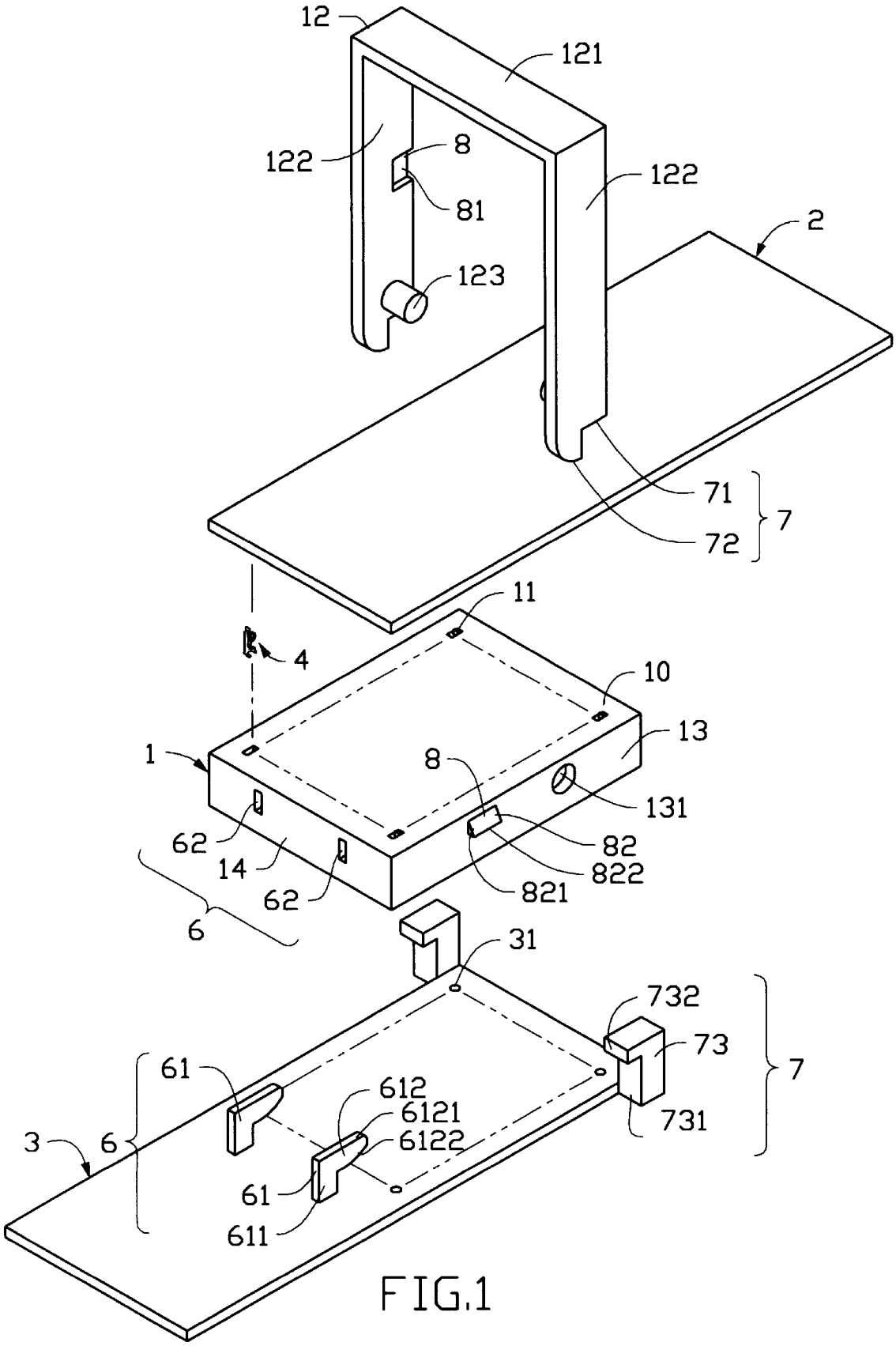
FIG. 1 is an exploded view of a connector block in accordance with the present invention and two printed circuit boards to be connected thereby.

Referring to FIG. 1, a board-to-board connector block 1 for horizontally and electrically engaging a secondary board 2 with a source board 3 includes an insulative housing 10, a plurality of resilient contacts 4 received in passageways 11 defined in the housing 10, a U-shaped lever 12 pivotably engaged with the housing 10, positioning means 6 for properly aligning the connector block 1 onto the source board 3, stabilizing means 7 for holding the contacts of the connector block in engagement with contact pads on the source board; and fastening means 8 for holding the lever 12 in place when in a locked position.

Figure 5:
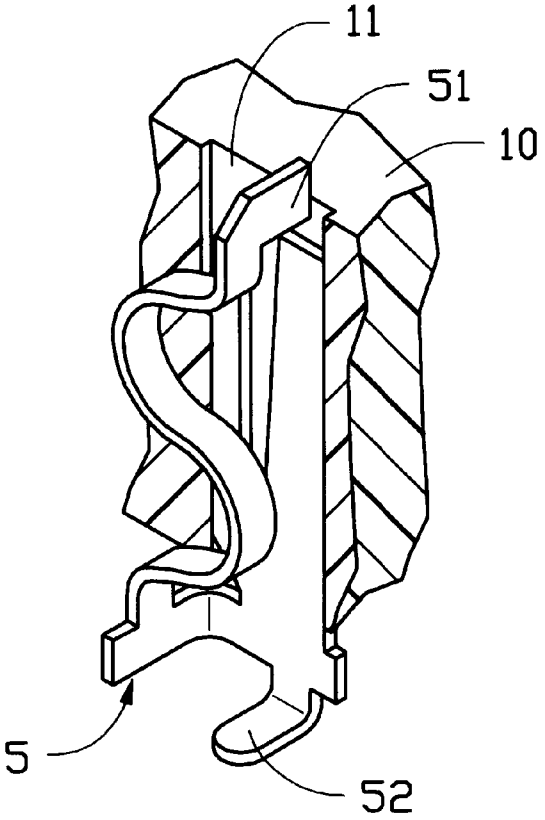
FIG. 5 is a perspective view of a contact received in a corresponding passageway defined in the connector block in accordance with the present invention, the bottom surface of the connector block showing at the upper side of the drawing.

Referring also to FIG. 5, each resilient contact 5 received in the passageways 11 of the housing 10 has an upper contact portion 52 projecting beyond a top surface of the housing 10 and a lower contact portion 51 projecting beyond a bottom surface of the housing 10. Each upper contact portion 52 is soldered to a corresponding contact pad (not shown) formed on a bottom surface of the secondary board 2, and each lower contact portion 51 projects beyond a bottom surface of the housing 10 to abut against a corresponding contact pad 31 formed on a top surface of the source board 3 for electrically connecting the two boards 2, 3.

The lever 12 includes an elongate base 121 and a pair of arms 122 extending from lateral ends of the base 121. A trunnion 123 is formed on an inner surface of each arm 122 near a free end thereof for pivotably engaging with holes 131 defined in opposite longitudinal walls 13 of the housing 10.

The positioning means 6 comprises two L-shaped locating shoes 61 formed on a top surface of the source board 3 and two corresponding openings 62 defined in a front lateral wall 14 of the housing 10. Each locating shoe 61 has a vertical portion 611 projecting from the top surface of the source board 3 and a horizontal portion 612 extending perpendicularly from the vertical portion 611 toward a rear end of the source board 3. The horizontal portion 612 has a straight upper edge 6121 and a curved lower edge 6122 between the upper edge 6121 and the vertical portion 611. The openings 62 of the housing 10 are adapted for snugly receiving the horizontal portions 612 of the corresponding locating shoes 61.

The stabilizing means 7 comprises a notch 71 defined in a rear side of a free end of each arm 122 of the lever 12, a curved surface 72 joining a surface of the notch 71 and a front side of the arm 122, and two L-shaped hold down shoes 73 having lower portions 731 secured to opposite lateral edges of the source board 3 and upper portions 732 extending from the lower portions 731 toward a front end of the source board 3.

The fastening means 8 comprises a recess 81 defined in the inner surface of each arm 122 between the trunnion 123 and the base 121 of the lever 12 and a pair of beveled projections 82 respectively formed on the opposite longitudinal sides 13 of the housing 10. Each beveled projection 82 has a slanted surface 821 sloping outward near a bottom surface of the housing 10 and an engagement surface 822 between the slanted surface 821 and the corresponding longitudinal side 13 of the housing 10.

Figure 2:
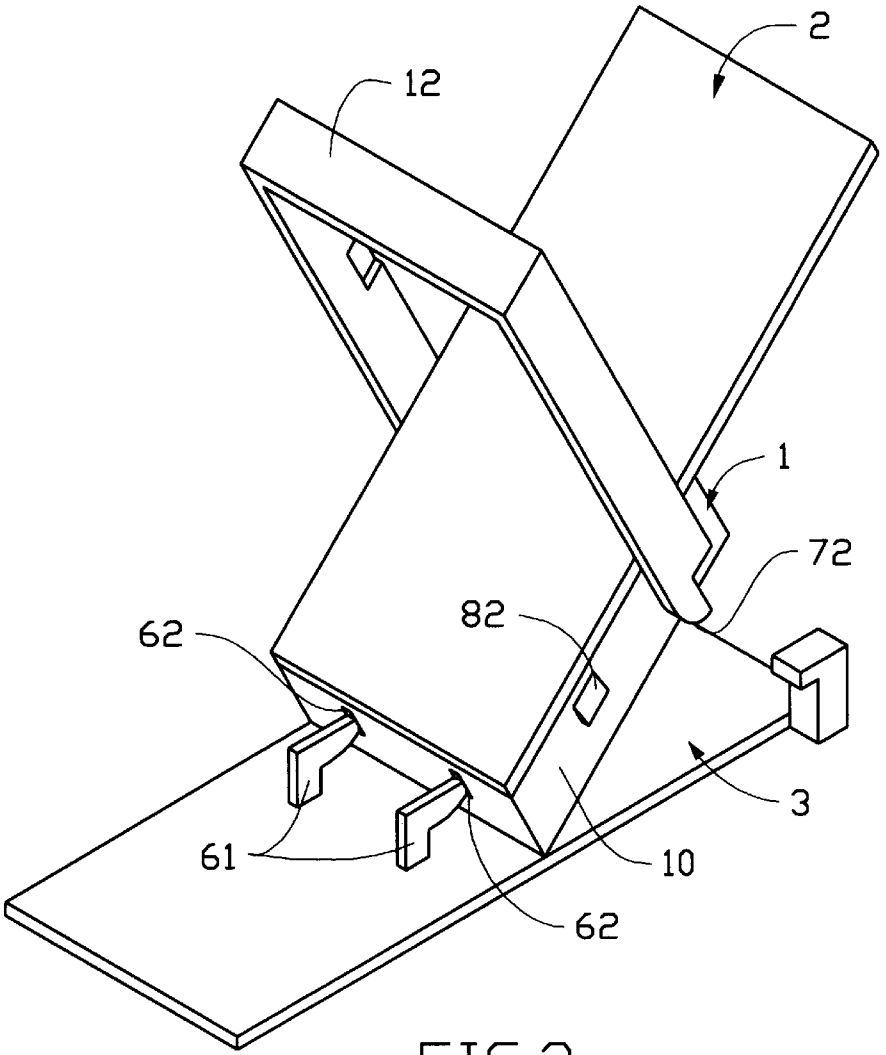
FIG. 2 shows the assembled connector block with a secondary board attached thereto at an initial insertion stage of assembly with a source board.
Figure 3:
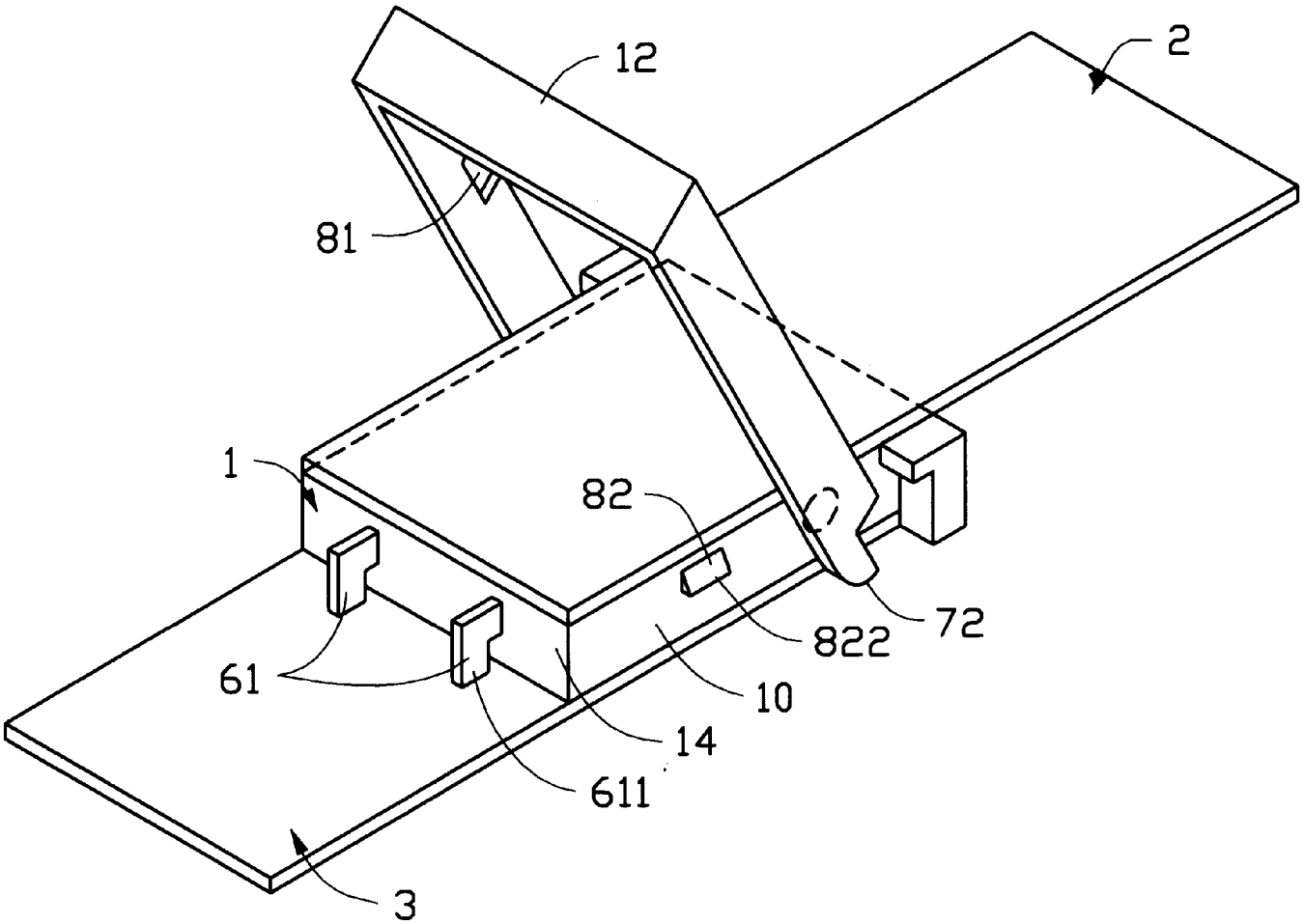
FIG. 3 shows an intermediate insertion stage of assembly of the connector block with the source board.
Figure 4:
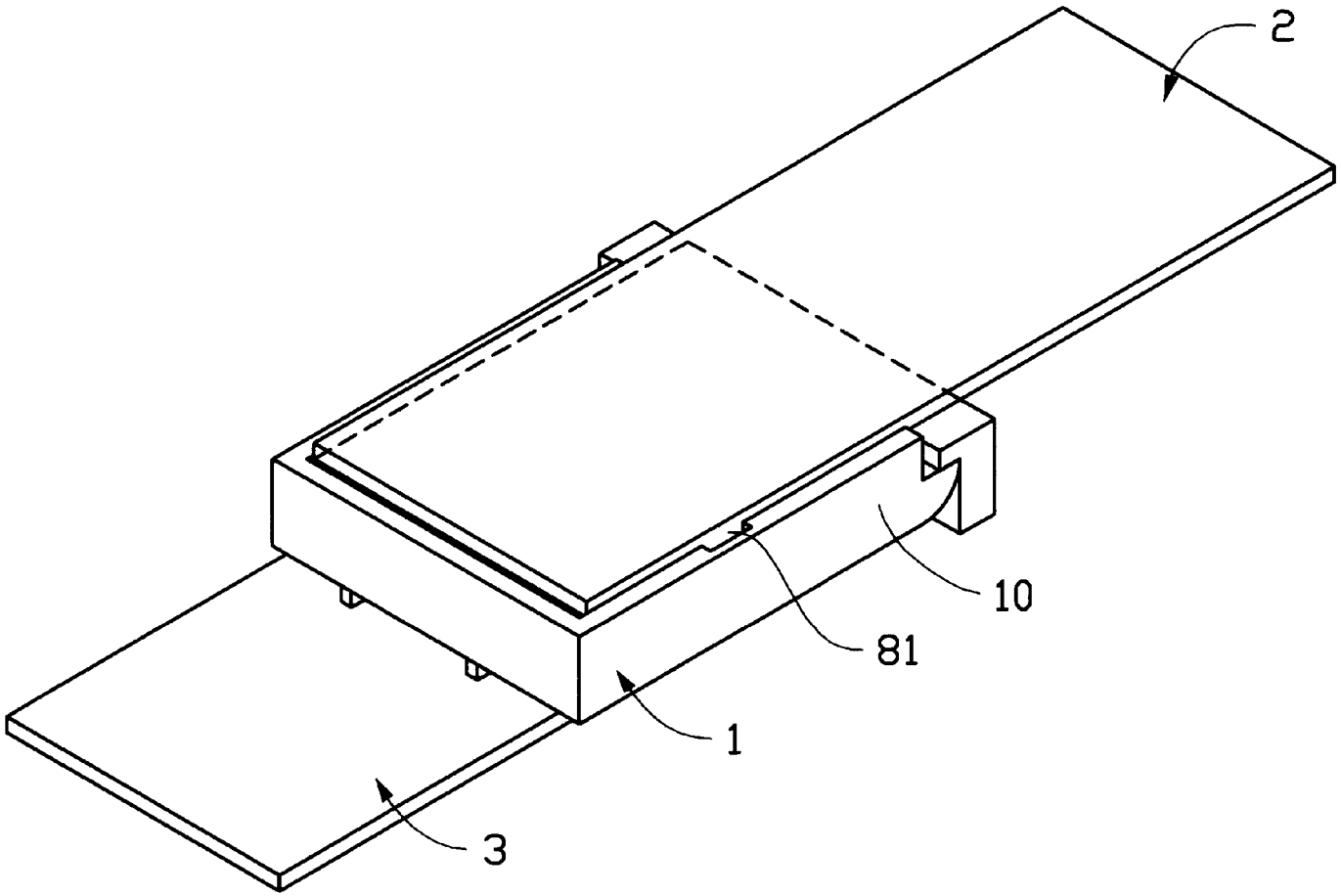
FIG. 4 shows a final insertion stage of assembly of the connector block with the primary circuit board.

In assembly, the secondary board 2 is surface mounted onto the connector block 1, the trunnions 123 of the lever 12 are inserted into the holes 131 of the housing 10, and the connector block 1 is brought to receive the locating shoes 61 in the corresponding openings 62 thereof as seen in FIG. 2. The curved surfaces 72 of the lever 12 facilitate the downward pivot thereof (FIG. 3) until the front lateral wall 14 of the housing 10 abuts against the vertical portions 611 of the locating shoes 61 and the projections 82 of the housing 10 are received in the corresponding recesses 81 of the lever 12. The engagement surface 822 of each projection 82 abuts against an inner surface of the corresponding recess 81 of the lever 12 to firmly secure the lever 12 in a locked position as seen in FIG. 4.

The force of the lever 12 acting on the two boards 2, 3 and the resilient contacts 4 of the connector block 1 results in a sufficient reactive force from each contact 4 to act on the corresponding contact pads 31 of the source board 3, whereby the connector block 1 provides a secure electrical engagement between the two boards 2, 3.

The above description clearly discloses a board-to-board connector block for horizontally and electrically engaging a secondary board with a source board. The disclosed connector block is easy to manufacture and assemble, and requires the soldering of only one board onto a surface of the connector block. The connector block also includes a closing mechanism for securely sandwiching the connector block between the two boards without requiring the use of external tools. Therefore, the present invention provides a board-to-board electrical connector with an improved function and design, and should be granted a patent.

While the present invention has been described with reference to specific embodiments, the description is illustrative of the invention and is not to be construed as limiting the invention.

Therefore, various modifications to the present invention can be made to the preferred embodiment by those skilled in the art without departing from the true spirit and scope of the invention as defined by the appended claims.

We claim:

1. A board-to-board connector block for horizontally and electrically engaging a secondary board with a source board including:

an insulative housing having a top surface, a bottom surface, a first side joining front ends of the top and bottom surfaces, a second side joining rear ends of the top and bottom surfaces, a third side joining lateral ends of the first and second sides, and a fourth side opposite the third side;

a plurality of passageways defined through the housing from the top surface to the bottom surface thereof;

a plurality of resilient contacts received in the passageways having portions thereof projecting beyond both the top and bottom surfaces of the housing for engaging with contact pads formed on a bottom surface of the secondary board and a top surface of the source board, respectively;

a lever including a base and a pair of arms extending from opposite lateral ends of the base for pivotably engaging with the housing;

positioning means for properly aligning the connector block onto the source board, the positioning means comprising a pair of locating shoes formed on a top surface of the source board and a pair of corresponding openings defined in the first side of the housing; and stabilizing means for holding the contacts of the connector block in engagement with contact pads on the source board, the stabilizing means comprising a notch defined in a rear side of a free end of each arm of the lever, a curved surface joining a surface of the notch and a front side of the corresponding arm of the lever, and a pair of hold down shoes respectively formed close to opposite lateral edges of the source board;

wherein the secondary board is surface mounted onto the connector block, the openings of the housing engage with the locating shoes of the positioning means, and the lever is pivotable downward to engage the notches of the stabilizing means with the hold down shoes of the stabilizing means to reach the locked position so that the hold down shoes of the stabilizing means exert a force on the notch surfaces of the lever so as to force the contact pads on the source board and the resilient contacts of the housing into secure electrical engagement.

2. The board-to-board connector block as claimed in claim 1, wherein a curved surface is formed to join a surface of the notch and a front side of the arm having the notch for facilitating the downward pivot movement of the lever until the lever reaches the locked position.

3. The board-to-board connector block as claimed in claim 1, wherein the connector block comprises a fastening means for securing the lever onto the connector block, the fastening means including a recess defined in the inner surface of each arm of the lever and a pair of beveled projections respectively formed on the third and fourth sides of the housing.

4. The connector block as described in claim 1, wherein the positioning means includes at least an L-shaped locating shoe formed on the top surface of the source board at a predetermined position and at least a corresponding opening defined in the first side of the housing.

5. The connector block as described in claim 1, wherein each locating shoe has a vertical portion projecting from the top surface of the source board and a horizontal portion extending perpendicularly from the vertical portion toward a rear end of the source board whereby the horizontal portion of each locating shoe is snugly received in the corresponding opening of the housing.

6. The connector block as described in claim 1, wherein each arm of the lever forms a trunnion on an inner surface thereof for pivotably engaging with a corresponding hole defined in the third and fourth sides of the housing, respectively.

7. The connector block as described in claim 1, wherein each hold down shoe has a lower portion secured to a lateral edge of the source board and an upper portion extending from the lower portion toward a front end of the source board.

8. The connector block as described in claim 1, wherein each hold down shoe of the stabilizing means has a lower portion integrally formed with a lateral edge of the source board and an upper portion extending from the lower portion toward a front end of the source board.

9. A board-to-board connector block for horizontally and electrically engaging a secondary board with a source board including:

an insulative housing having a top surface, a bottom surface, a first side joining front ends of the top and bottom surfaces, a second side joining rear ends of the top and bottom surfaces, a third side joining lateral ends of the first and second sides, and a fourth side opposite the third side;

a plurality of passageways defined through the housing from the top surface to the bottom surface thereof;

a corresponding plurality of resilient contacts received in the passageways having contact portions projecting beyond both the top and bottom surfaces of the housing for engaging with the contact pads of the secondary and source boards, respectively;

a lever including a base and a pair of arms extending from lateral ends of the base for pivotably engaging with the third and fourth side walls of the housing, a trunnion being formed on the inner surface of each arm of the lever for pivotably engaging with the housing, respectively;

positioning means for properly aligning the connector block onto the source board, the positioning means comprising a pair of locating shoes formed on a top surface of the source board and a pair of corresponding openings defined in the first side of the housing; and fastening means for securing the lever onto the connector block, the fastening means comprising a recess defined in the inner surface of each arm of the lever and a pair of beveled projections respectively formed on the third and fourth sides of the housing;

whereby the secondary board is surface mounted onto the connector block, the openings of the housing engage with corresponding locating shoes of the positioning means, and the lever is pivoted downward to engage the recesses thereof with corresponding beveled projections of the fastening means in the locked position where the force of the lever acting between the source board and the resilient contacts of the housing results in a sufficient force on each contact to provide a secure electrical engagement between the source board and the contacts of the housing.

10. The connector block as described in claim 9, wherein a trunnion is formed on the inner surface of each arm of the lever for pivotably engaging with corresponding holes defined in the third and fourth sides of the housing, respectively.

11. The connector block as described in claim 10, wherein the fastening means comprises a recess defined in the inner surface of each arm between the trunnion and the base of the lever, and a beveled projection formed on each of the third and fourth sides of the housing, whereby the beveled projections of the housing are received in the recesses of the corresponding arm of the lever when the lever is in the locked position.

12. The connector block as described in claim 9, wherein each beveled projection of the fastening means has a slanted surface sloping outward near the bottom surface of the housing and an engagement surface between the slanted surface and the corresponding side of the housing whereby the engagement surface abuts against an inner surface of the corresponding recess of the lever to firmly secure the lever in the locked position.

13. A board-to-board connector block for horizontally and electrically engaging a secondary board with a source board including:

an insulative housing having a top surface, a bottom surface, a first side joining front ends of the top and bottom surfaces, a second side joining rear ends of the top and bottom surfaces, a third side joining lateral ends of the first and second sides, and a fourth side opposite the third side;

a plurality of passageways defined through the housing from the top surface to the bottom surface thereof;

a plurality of resilient contacts received in the passageways having portions thereof projecting beyond both the top and bottom surfaces of the housing for engaging with contact pads formed on a bottom surface of the secondary board and a top surface of the source board, respectively;

a lever including a base and a pair of arms extending from lateral ends of the base for pivotably engaging with the housing;

positioning means for properly aligning the connector block onto the source board, the positioning means comprising a pair of locating shoes formed on a top surface of the source board and a pair of corresponding openings defined in the first side of the housing;

stabilizing means for holding the contacts of the connector block in engagement with contact pads on the source board, the stabilizing means comprising a notch defined in a rear side of a free end of an arm of the lever, and a hold down shoe formed close to a lateral edge of the source board; and fastening means for securing the lever onto the connector block, the fastening means comprising a recess defined in the inner surface of each arm of the lever and a pair of beveled projections respectively formed on the third and fourth sides of the housing;

whereby the secondary board is surface mounted onto the connector block, the connector block is positioned on the source board, the openings of the housing engage with corresponding locating shoes of the positioning means, and the lever is pivoted downward to respectively engage the notches thereof and the recesses thereof with corresponding hold down shoes of the stabilizing means and corresponding beveled projections of the fastening means to reach a locked position where the force of the lever acting between the source board and the resilient contacts of the housing results in a sufficient force on each contact to provide a secure electrical engagement between the source board and the contacts of the housing.

14. A connector-board assembly, comprising:

a connector block including a housing with a plurality of contacts therein, each of said contacts including a first end and a second end projecting beyond a first surface and a second surface of the housing;

a first board attached to the first surface of the connector housing for electrical engagement with the first ends of the contacts; and means for securing the connector block with the associated first board to a second board wherein the second board is attached to the second surface of the housing for electrical engagement with the second ends of the contacts wherein said means includes positioning means for properly aligning the connector block to the second board, the positioning means comprising a pair of locating shoes formed on a top surface of the second board and a pair of corresponding openings defined in the first side of the housing.

15. The assembly as described in claim 14, wherein said first board is permanently attached to the connector block while the second board is detachably attached to the connector block.

16. The assembly as described in claim 14, wherein said means includes stabilizing means for holding the connector block in a locked position with regard to the second board.

17. The connector-board assembly as described in claim 12, wherein the means for securing the connector block with the associated first board to a second board comprises a fastening means for securing the lever onto the connector block, the fastening means including a recess defined in the inner surface of each arm of the lever and a pair of beveled projections respectively formed on the third and fourth sides of the housing.

18. The connector-board assembly as described in claim 14, wherein said means includes a lever having a base and a pair of arms extending respectively from opposite lateral edges of the base for pivotably engaging with the housing.

19. The connector-board assembly as described in claim 18, wherein a notch is defined in a rear side of a free end of an arm of the lever for engaging with a hold down shoe formed close to a lateral edge of the source board.

* * * * *